United States Patent [19]

Zarnoti

[11] Patent Number: 4,986,547

[45] Date of Patent: Jan. 22, 1991

[54] GAME APPARATUS

[76] Inventor: Sandor Zarnoti, P.O. Box 1256, Marathon, Fla. 33050

[21] Appl. No.: 350,842

[22] Filed: May 11, 1989

[51] Int. Cl.[5] ..... A63F 3/00

[52] U.S. Cl. ..... 273/241; 273/148 R; 273/273; 206/315.1

[58] Field of Search ..... 273/241, 280, 283, 148 A, 273/148 R, 271, 290, 273; 206/315.1, 579; 211/49.1; 232/1 D

[56] References Cited

U.S. PATENT DOCUMENTS

| | | | |
|---|---|---|---|
| D. 156,570 | 0/1949 | Smith | 273/148 R |
| 572,388 | 12/1896 | Kuran | 273/236 |
| 680,324 | 12/1901 | Gedge | 273/271 |
| 783,478 | 2/1905 | Strauss | 211/58 |
| 818,409 | 4/1906 | Bolton | 273/271 |
| 1,206,334 | 11/1016 | Kohler | 273/271 |
| 1,820,617 | 0/1931 | Holmberg | 273/148 R |
| 2,435,698 | 6/1944 | Running | 211/49.1 |
| 4,497,491 | 2/1985 | Holman | 273/271 |

FOREIGN PATENT DOCUMENTS

| | | | |
|---|---|---|---|
| 738837 | 10/1955 | United Kingdom | 232/1 D |
| 2066086 | 7/1981 | United Kingdom | 273/274 |

*Primary Examiner*—Edward M. Coven
*Assistant Examiner*—Sebastiano Passaniti
*Attorney, Agent, or Firm*—Gunn, Lee & Miller

[57] ABSTRACT

The invention is a game apparatus useable with numerically differentiated playing disks. The apparatus has multiple vertical slots and horizontal recesses on a playing surface each for receiving a single playing disk. The apparatus principally includes a combination cover/-playing surface and a removable base. The two components define a storage space where playing disks may be stored between uses of the apparatus.

10 Claims, 2 Drawing Sheets

GAME APPARATUS

BACKGROUND OF THE INVENTION

1. Field of the Invention:

Applicant's invention relates to apparatuses for playing parlour games involving strategy and memory related skills.

2. Background Information:

Many United States patents have issued for game apparatuses, the use of which involves rules by which a winning player will have amassed a maximum number of points and/or will have arranged game pieces in a preferred configuration as determinable by certain nomenclature provided on the game pieces. The following United States patents are, in varying degrees, relative to such apparatuses and associated game rules: No. 4,119,320 issued to Chorba et al; No. 4,385,763 issued to Moscovich; No. 3,674,274 issued to Schur; No. 3,866,918 issued to Goldfarb et al; No. 572,388 issued to Van Kuran; No. 680,324 issued to Gedge; No. 818,409 issued to Bolton; No. 1,206,334 issued to Kohler; and No. 4,497,491 issued to Holman.

A limitation common to most game apparatuses is the degree to which an apparatus is suitable without modification for playing a number of different games.

SUMMARY OF THE INVENTION

It is an object of the present invention to provide a game apparatus which is suitable in playing a multiplicity of games.

It is another object of the present invention to provide a game apparatus which, though inexpensive, serves as the basis for a variety of parlour games.

It is another object of the present invention to provide a game apparatus which is useful in playing parlour games involving the use of playing pieces with assorted nomenclature thereon.

It is another object of the present invention to provide a game apparatus which simultaneously serves as a playing surface for parlour games and as a carrying case for playing pieces.

It is another object of the present invention to provide a game apparatus which is useful in playing a multiplicity of games based on the arrangement and/or accumulation of numerically differentiated game pieces.

In satisfaction of these and realted objectives, Applicant's invention provides a game apparatus which facilitates the use of a number of circular, disk-like playing pieces which are differentiated from each other by nomenclature exhibited thereon. The apparatus includes a cover/playing surface with a plurality of playing piece receptacles formed on the outer surface thereof. The cover/playing surface in conjunction with a removable base member defines a storage area wherein the game pieces may be stored and carried between uses. The game apparatus is suitable for use in playing a variety of games employing rules and objectives of varying difficulty to suit a wide variety of age groups and tastes.

FIG. *2a* is a top plan view of one half of the cover/playing surface member of Applicant's game apparatus.

FIG. *2b* is a top plan view of one half of the base member of Applicant's game apparatus with the cover/playing surface member removed.

Figure 3:
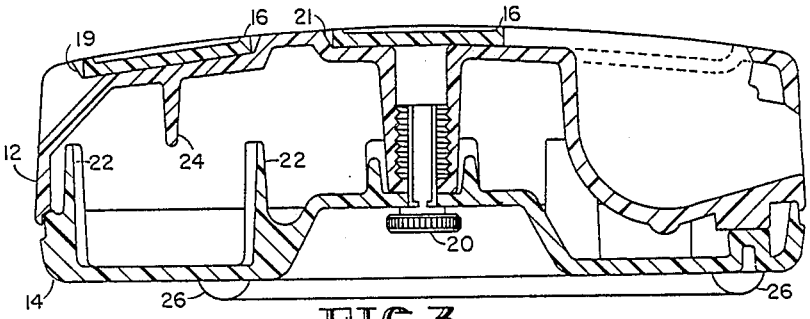

FIG. 3 is a sagittal, cross-sectional view of Applicant's fully assembled game apparatus along line 3—3 as referenced in FIGS. *2a* and *2b*.

Figure 1:
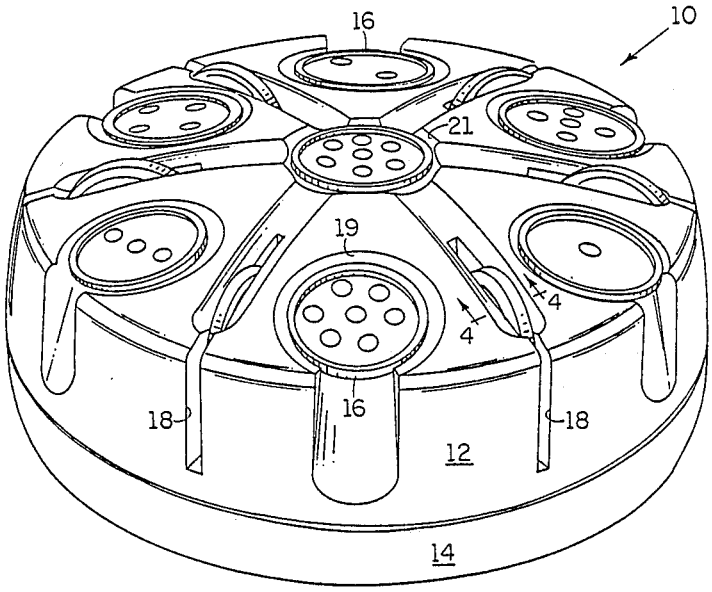
FIG. 1 is a perspective view of Applicant's fully assembled game apparatus with playing pieces shown positioned in playing piece receptacles.
Figure 4:
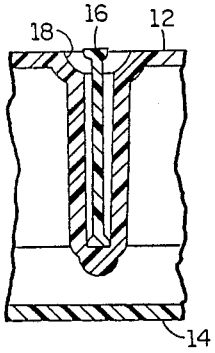
Figure 2A:
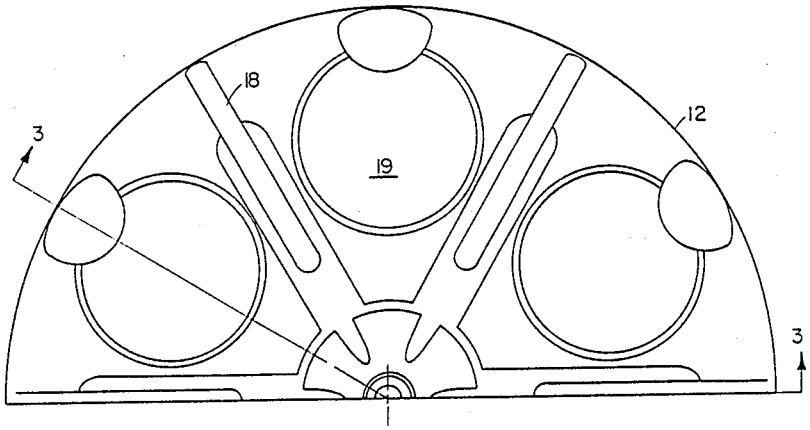
Figure 2B:
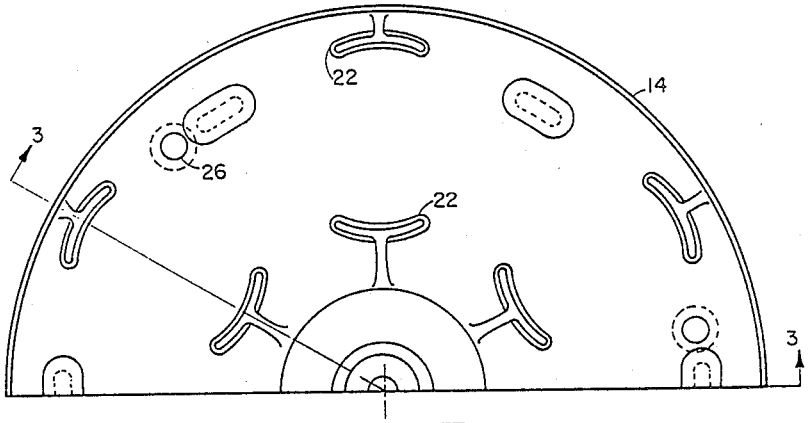

FIG. 4 is a partial cross-sectional view of FIG. 1 along line 4—4.

DETAILED DESCRIPTION OF THE PREFERRED EMBODIMENT

Referring to FIG. 1, the fully assembled game apparatus of Applicant's preferred embodiment is identified by the reference numeral 10. The apparatus principally comprises a cover/playing surface member 12 and a base member 14. In the preferred embodiment, the apparatus 10 is accompanied by a plurality of game pieces 16.

Referring principally to FIGS. 1, *2a* and 4, the cover/playing surface member 12 in the preferred embodiment is designed for accommodating 13 of the game pieces 16. Any one game piece 16 may be received in either one of the six vertically oriented slots 18, one of the six substantially horizontal recesses 19 around the periphery of the cover/playing surface member 12, or in the single substantially horizontally oriented recess 21 positioned at the radial center of the cover/playing surface member 12. It is noted that games rules which concentrate on use of the slots 18 demand more memory skills than rules which focus on the recesses 19 or 21.

Referring principally to FIGS. *2b* and 3, the base member 14 is designed to be removably attached to the underside of cover/playing surface member 12 using a screw 20 and an appropriately sized and positioned threaded orifice in the base member 14. The base member 14 has, in the preferred embodiment, six paired game piece retainers 22 between which a stack of game pieces 16 may be retained between uses of the game apparatus 10. As shown in FIG. *2b*, the game piece retainers 22 are formed to define an arc in horizontal cross section and to have a similar (at least as large) radius of curvature as the periphery of the game pieces 16. Of course, the game piece retainers 22 are spaced for receiving game pieces 16 therebetween.

Referring principally to FIG. 3, the cover/playing surface member 12 is formed to have a game piece retaining projection 24 positioned for centrally overlying the storage space defined by each pair of the game piece retainers 22 when the cover/playing surface member 12 and the base member 14 are mated and secured one to the other by the screw 20. This arrangement prevents the game pieces 16 from falling from the space defined by each pair of the game piece retainers 22 as the game apparatus 10 is transported or stored in other than the horizontal orientation as when it is used in play.

In the preferred embodiment, the cover/playing surface member 12 and the base member 14 are molded of a suitable plastic material. The use of plastic in manufacturing the game apparatus 10 facilitates low manufacturing costs. In addition, plastic is easily cleaned by washing or wiping with a damp cloth, thereby providing a benefit of convenience to the ultimate user.

The game pieces 16 accompanying or for use with a game apparatus 10 of the preferred embodiment are impressed with one or more circular indentations (with a maximum of seven such indentations in each disk)

which indentations define the value of each chip for playing purposes, much like the indicia on dice. The use of palpable indentations as opposed to indicia limited to visual perception is directed toward the needs of potential users with impaired vision. In addition, chips of this nature have a virtually unlimited service expectancy. The preferred embodiment includes six game pieces 16 each of six game pieces 16 differentiated numerically as to point value by the above described indicia. Of course, alternative indicia not necessarily numerically related may be used depending on the particular game being played. For example, playing disks with animals or cartoon characters (not shown) may be more appropriate for children's games.

The base member 14 of the preferred embodiment includes three rubber-like feet members 26 for providing sure footing on a table surface.

Applicant's game apparatus 10 is suitable for use in playing a variety of games. By varying rules pertaining to the game piece receptacles to be used; whether or not and in what configuration game pieces have preferential arrangements; the order of play; the number of participants; and the method of distributing game pieces to players; such a variety of games may be created and played using the game apparatus 10.

To illustrate just one possible example, game pieces 16 may be randomly and evenly distributed to players and thereafter each player places one game piece in a vacant games piece receptacle (18, 19 or 21) of his or her choice with the object being to achieve a configuration involving three sequentially numbered game pieces, one each being in a slot 18, a horizontal receptacle 19, and the center receptacle 21. Once this configuration has been achieved by a player, that player removes the three pieces 16 and is awarded the number of points which represents the cumulative face value of the three game pieces 16. The process then continues until a player again achieves a preferred configuration. The various alternative numeric sequences and/or physical arrangements may be given point values separate and apart from the face values of the games pieces 16 to further challenge and entertain the players. The winner of the game would be that person who, after the game pieces 16 have been depleted to a point where no further play is possible under the prevailing rules, has amassed the largest number of points. Obviously, there is a myriad of alternative sets of game rules by which users of the game apparatus 10 may play.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A game apparatus comprising:

a plurality of games pieces;

a cover member having a generally horizontal and upwardly facing playing surface that is presented to a player when said apparatus is used and placed on a substantially flat, horizontal surface, said cover member having a plurality of receptacles formed therein for receiving said game pieces, said plurality of receptacles comprising:

receptacles of a first configuration defining a narrow elongated opening vertically oriented relative to said playing surface and situated peripherally about said playing surface for receiving, maintaining, and partially concealing one of said game pieces therein in a generally vertical orientation relative to said playing surface;

receptacles of a second configuration defining a substantially horizontal, game piece shaped recess in said playing surface for receiving, maintaining, and displaying one of said game pieces therein in a generally horizontal orientation relative to said playing surface, said receptacles of said second configuration being situated peripherally about said playing surface adjacent to said receptacles of said first configuration;

a receptacle of a third configuration defining a single, substantially horizontal, game piece shaped recess in said playing surface for receiving, maintaining, and displaying one of said game pieces therein in a generally horizontal orientation relative to said playing surface, said receptacle of said third configuration being situated near the center of said playing surface; and a base member removably attachable to an underside of said cover member, said base member, in conjunction with said cover member, defining a closed space for retaining said game pieces when said game apparatus is not in use.

2. The game apparatus of claim 1 wherein said game pieces are circular and disk-shaped, and said receptacles are formed for receiving said circular, disk-shaped game pieces.

3. The game apparatus of claim 1 wherein said cover member defines a radially symmetrical playing surface and said receptacles of said vertical first configuration and said horizontal second configuration are equidistantly and alternatingly situated about the periphery of said playing surface.

4. The game apparatus of claim 1 wherein one or more pairs of game piece retaining members are formed as part of said base member and oriented relative thereto to extend into said closed space when said base member is joined with said cover member, said game piece retaining members being shaped whereby a plurality of said game pieces may be vertically stacked and maintained between said game piece retaining members of each said pair.

5. The game apparatus of claim 4 wherein said game pieces are circular and disk-shaped and said game piece retaining members are shaped and oriented such that each pair of said game piece retaining members define an inner surface are having a radius of curvature substantially conforming to the radius of curvature of said game pieces, and such that each pair of said game piece retaining pair members define portions of an imaginary circle wherein a plurality of said game pieces may reside in a vertical stack.

6. A game apparatus comprising:

a plurality of circular, disk-shaped game pieces;

a cover surface member having a generally horizontal, radially symmetrical, and upwardly facing playing surface that is presented to a player when said apparatus is used and placed on a substantially flat, horizontal surface, said cover member having a plurality of receptacles formed therein for receiving said game pieces, said plurality of receptacles comprising:

receptacles of a first configuration defining a narrow elongated opening vertically oriented relative to said playing surface and situated peripherally about said playing surface for receiving, maintaining, and partially concealing one of said game pieces therein in a generally vertical orientation relative to said horizontal playing surface;

receptacles of a second configuration defining a substantially horizontal, game piece shaped recess in said playing surface for receiving, maintaining, and displaying one of said game pieces therein in a generally horizontal orientation relative to said playing surface, said receptacles of said second configuration being situated peripherally about said playing surface adjacent to said receptacles of said first configuration, said receptacles of said first configuration and said second configuration being equidistantly and alternatingly situated about the periphery of said playing surface;

a receptacle of a third configuration defining a single, substantially horizontal, game piece shaped, recess in said playing surface for receiving, maintaing, and displaying one of said game pieces therein a generally horizontal orientation relative to said playing surface, said receptacle of said third configuration being situated near the center of said playing surface;

a base member removably attachable to an underside of said cover member, said base member, in conjunction with said cover member, defining a closed space for retaining said game pieces when said game apparatus is not in use, wherein one or more pairs of game piece retaining members are formed as part of said base member and oriented relative thereto to extend into said closed space when said base member is joined with said cover member, said game piece retaining members being shaped and oriented such that each pair of said game piece retaining members define an inner surface arc having a radius of curvature substantially conforming to the radius of curvature of said game pieces, and such that each pair of said game piece retaining members define portions of an imaginary circle wherein a plurality of said game pieces may be vertically stacked and maintained between said game piece retaining members of each said pair.

7. A game apparatus comprising:

a plurality of circular, disk-shaped game pieces;

a playing surface member having an interior face and an exterior face, said exterior face defining a playing surface, said playing surface having a plurality of narrow, vertically oriented first recesses and a plurality of shallow, circular, horizontally shaped second recesses formed there into, each of said first recesses for receiving, maintaining, and partially concealing, one of said game pieces in a vertical orientation during use of said apparatus, and each of said second recesses for receiving, maintaining, and displaying, one of said game pieces in a horizontal orientation during use of said apparatus, said playing surface member further comprising a continuous circumferential side surface extending peripherally downward from said interior face and oriented substantially perpendicular to said interior and exterior faces, said side surface defining a cylindrical space permanently closed at its upper end by said interior face; and a base member for closing said cylindrical space and having means for enabling removable attachment thereof to an underside of said playing surface member, wherein one or more pairs of game piece retaining members are formed as part of said base member and oriented relative thereto to extend into said cylindrical space when said base member is joined with said playing surface member, said game piece retaining members being shaped whereby said game pieces may be vertically stacked and maintained between said game piece retaining members of each said pair.

8. The game apparatus of claim 7 wherein said interior face of said playing surface member has a plurality of game piece retainer projections positioned and sized for extending into an area between each of said pairs of game piece retaining members when said playing surface member and said base member are joined together, said projections maintaining said game pieces between said retaining members during transport or storage of said apparatus.

9. The invention of claim 7 wherein said circular, disk-shaped game pieces, have one or more indentations on one or both of two faces thereof for indicating a point value of each of said game pieces, and wherein said game pieces are divisible into two or more subsets with said game pieces of each said subset having like indicia thereon which differentiate said game pieces in said subset from said game pieces from said other subset or subsets.

10. The invention of claim 8 wherein said circular, disk-shaped game pieces, have one or more indentations on one or both of two faces thereof for indicating a point value of each of said game pieces, and wherein said game pieces are divisible into two or more subsets with said game pieces of each said subset having like indicia thereon which differentiate said game pieces in said subset from said game pieces of said other subset or subsets.

* * * * *